US005320043A

United States Patent [19]

Andre et al.

[11] Patent Number: 5,320,043

[45] Date of Patent: * Jun. 14, 1994

[54] LOW-VULNERABILITY EXPLOSIVE MUNITIONS ELEMENT INCLUDING A MULTICOMPOSITION EXPLOSIVE CHARGE, AND METHOD FOR OBTAINING A BLAST AND/OR BUBBLE EFFECT

[75] Inventors: Michel Andre, Bretigny; Jean-Pierre Mazer, Vert le Petit; Bruno Nouguez, Ballancourt, all of France

[73] Assignee: SNPE Inc., Princeton, N.J.

[ * ] Notice: The portion of the term of this patent subsequent to Feb. 23, 2010 has been disclaimed.

[21] Appl. No.: 9,476

[22] Filed: Jan. 29, 1993

Related U.S. Application Data

[63] Continuation-in-part of Ser. No. 738,310, Jul. 31, 1991, Pat. No. 5,189,247.

[30] Foreign Application Priority Data

Oct. 17, 1990 [FR] France ..... 90 12797

[51] Int. Cl.[5] ..... C06B 45/00; C06B 31/28; C06B 33/14

[52] U.S. Cl. ..... 102/291; 102/292; 149/19.4; 149/38; 149/41; 149/46

[58] Field of Search ..... 102/291, 292, 286; 149/19.4, 38, 41, 46

[56] References Cited

U.S. PATENT DOCUMENTS

| | | | |
|---|---|---|---|
| 1,785,529 | 12/1930 | Pratt | 149/19.4 |
| 2,669,182 | 2/1954 | Weiss | 102/66 |
| 3,598,667 | 8/1971 | Brock et al. | 149/19.4 |
| 4,332,632 | 6/1982 | Conyers et al. | 149/19.4 X |
| 4,555,277 | 11/1985 | Scribner | 149/19.4 X |
| 4,657,607 | 4/1987 | Perotto et al. | 149/19.4 X |
| 4,952,254 | 8/1990 | Betts et al. | 149/19.4 |
| 5,031,539 | 7/1991 | Hutchens | 149/19.4 |
| 5,085,725 | 2/1992 | Sayles | 102/291 X |
| 5,151,138 | 9/1992 | Lownds | 149/21 |
| 5,160,387 | 11/1992 | Sujansky | 149/2 |
| 5,189,247 | 2/1993 | Andre et al. | 102/291 |

FOREIGN PATENT DOCUMENTS

| | | |
|---|---|---|
| 298509 | 3/1916 | Fed. Rep. of Germany . |
| 796861 | 4/1936 | France . |
| 1155789 | 12/1957 | France . |
| 2225979 | 11/1974 | France . |
| 2365774 | 9/1976 | France . |
| 2502768 | 3/1981 | France . |

OTHER PUBLICATIONS

Military Fire Fighter, May 1989, "Insensitive Munitions-A Fire Safety Plus?".

"Les poudres, propergols et explosifs", Tome 1, J. Quinchon, pp. 190–192.

*Primary Examiner*—Peter A. Nelson

*Attorney, Agent, or Firm*—Cushman, Darby & Cushman

[57] ABSTRACT

The invention relates to a low-vulnerability explosive munitions element comprising a casing containing a multicomposition explosive charge, the innermost layer of which is a composite explosive comprising a filled polyurethane or polyester polymer matrix, the filling of which contains more than 20% by weight of organic nitrate explosive, and the peripheral layer of which is a pyrotechnic composition of the family of composite solid propellants comprising a filled polyurethane or polyester polymer matrix the filling of which contains at least one mineral oxidant and less than 17% by weight of organic nitrate explosive. The blast and/or bubble effect produced is close to that produced by the much more-vulnerable charge of monocomposition composite explosive of equivalent mass. The invention also relates to a method for obtaining a blast and/or bubble effect by releasing in the casing of an aforementioned munitions element according to the invention, and then rupture of the casing. The release of gas is obtained by detonation of the innermost layer and then reaction without detonation of the peripheral layer.

19 Claims, No Drawings

LOW-VULNERABILITY EXPLOSIVE MUNITIONS ELEMENT INCLUDING A MULTICOMPOSITION EXPLOSIVE CHARGE, AND METHOD FOR OBTAINING A BLAST AND/OR BUBBLE EFFECT

This application is a continuation-in-part of our application Ser. No. 07/738,310, filed Jul. 31, 1991, now U.S. Pat. No. 5,189,247.

The present invention is in the field of low-risk munitions, particularly military munitions. It relates to a low-vulnerability explosive munitions element comprising a generally metal casing containing an explosive charge. These munitions are useful in particular to generate a blast effect in the air, or a bubble effect underwater. The charge and its casing generally have axial symmetry (surface of revolution), so as to generate symmetrical effects. The explosive munitions, in particular in storage or transport, may be subjected to such actions as fire, impact and the penetration of fragments or balls, or the close detonation of nearby munitions.

Although the problems of fire and fragments can be practically solved with the aid of usual composite explosives, the problem of detonation by influence, more particularly the sensitivity to close detonation of nearby munitions, has not yet been satisfactorily solved.

It is well known to use composite explosives, in particular insensitive explosives, for example filled with 5-oxo-3-nitro-1,2,4-triazole (ONTA), triaminotrinitrobenzene (TATB), or nitroguanidine. However, this solution has two major disadvantages. The first is that the vulnerability of the munitions to the close detonation of nearby munitions is then dependent on that of the priming system. These insensitive composite explosives generally have a high critical diameter that can exceed 10 cm, and cannot be primed classically except with a powerful, large-sized relay which is accordingly particularly sensitive and vulnerable. The second major disadvantage is that even a very insensitive explosive like those mentioned above can detonate by influence, beyond a certain caliber.

Conventionally, the term "composite explosive" means a functionally detonatable pyrotechnic composition comprising a filled solid polymer matrix, generally polyurethane or polyester, the filling being in powder form and containing primarily an organic nitrate explosive filling, such as Hexogen, Octogen, ONTA, or a mixture of at least two of these compounds. Composite explosives (also called plastic bonded explosives or PBXs or cast plastic bonded explosives) and how they are obtained are described for instance by J. Quinchon, in "Les poudres propergols et explosifs", Vol. 1, *Les explosifs, Technique et Documentation,* 1982, pp. 190–192.

French Patent 2 365 774 describes an approximately cylindrical explosive munitions element comprising a casing containing a multicomposition charge, which may be a composite explosive. This multicomposition charge includes a plurality of adjacent coaxial annular layers, the peripheral layer having a higher content of powerful heavy explosive (Hexogen, Octogen) than that immediately adjacent to it, and so forth until the central axial layer, which is in the form of a solid cylinder and has the lowest content of powerful heavy explosive. Hence this kind of explosive munitions element is particularly vulnerable.

Moreover, the article entitled "Insensitive Munitions—A fire safety plus?", which appeared in May 1989 on pp 74–81 of the Journal "Military Fire Fighter", teaches that the vulnerability of a munitions element filled with vulnerable composite explosive can be reduced by coating the explosive with a less-vulnerable composite explosive. Nevertheless, as indicated above, insensitive composite explosives are not entirely risk-free.

Hence those skilled in the art seek a more satisfactory solution than the aforementioned known ones, with which the vulnerability of the charge or rather that of the munitions element comprising this charge and its priming relay can be reduced further, while the requisite performance in terms of the blast and/or bubble effect sought is still preserved.

The present invention proposes such a solution. It has been discovered that unexpectedly, the vulnerability of an explosive munitions element comprising a casing that is generally and preferably of metal, containing a composite explosive comprising a polyurethane or polyester polymer matrix filled on the one hand with powdered organic nitrate explosive and on the other with a powdered filling free of organic nitrate explosive but including at least one mineral oxidant, is diminished by distributing the organic nitrate explosive and the filling free of organic nitrate explosive in the polyurethane or polyester polymer matrix in such a way as to make a multicomposition charge, preferably a bicomposition charge, the innermost layer of which is a composite explosive the filling of which contains more than 20% by weight of organic nitrate explosive, this percentage being expressed with respect to the composite explosive, and the peripheral layer of which is a pyrotechnic composition comprising a filled polyurethane or polyester polymer matrix, this filling containing at least one mineral oxidant and less than 17% by weight of organic nitrate explosive, the percentage being expressed with respect to the pyrotechnic composition, while practically the same level of performance, that is, the same blast and/or bubble effect, is preserved.

The pyrotechnic composition of the peripheral layer is of the composite solid propellant family.

The term "composite solid propellant" is conventionally used for a pyrotechnic composition made in a manner identical to that of a composite explosive, and comprising a filled solid polymer matrix, generally polyurethane or polyester, the filling being powdered and essentially comprising a mineral oxidant and generally a reducing metal. The filling may also contain an organic nitrate explosive. Since their purpose is propulsion, composite solid propellants are functionally combustible and include various additives to control the propulsion. Composite solid propellants and the way in which they are obtained are described for instance by A. Davenas, in Technologie des propergols solides, Ed. Masson, 1989.

In the present invention, since the propulsive function is neither sought nor utilized, the present applicant does not wish to designate the peripheral layer as "propellant", although the composition of this layer differs from that of composite solid propellants only in the absence of additives associated with the propulsive function of propellants (that is, ballistic additives, combustion accelerators, and so forth), and prefers to use the term "pyrotechnic composition of the family of composite solid propellants".

Moreover, since aliphatic nitrate derivatives have not yet gained any major industrial application as an explosive, the term "organic nitrate explosive" is conventionally meant as an explosive selected from the group comprising the aromatic nitrate explosives (including at least one C—$NO_2$ group, the carbon atom being part of an aromatic ring), the nitric ester explosives (including at least one C—O—$NO_2$ group), and the nitramine explosives (including at least one C—N—$NO_2$ group).

It has also been discovered in general that the surprising result referred to above is also obtained when the polymer matrix of the composite explosive differs from that of the pyrotechnic composition of the family of composite solid propellants.

It must be recalled that functionally, although a composite explosive detonates, a composite solid propellant burns without detonating. The phenomena of combustion and detonation are well defined and differentiated, and are known to one skilled in the art. Reference may for instance be made to the aforementioned work by J. Quinchon, pp. 12 and 13.

Hence one skilled in the art is quite surprised to find that practically the same level of blast and/or bubble effect is maintained, compared with the equivalent mass of composite explosive which detonates in totality, while the peripheral layer of the charge reacts without detonating, even when explosive fillings such as Octogen and ammonium perchlorate are contained in this peripheral layer.

Moreover, this multicomposition configuration, with a peripheral layer of pyrotechnic composition of the family of composite solid propellants the filling of which contains at least one mineral oxidant and less than 10% by weight of organic nitrate explosive, preferably 0%, imparts to the munitions element a quasi-invulnerability to the close detonation of nearby munitions.

In addition, the element according to the invention is easier to prime, by a relay in contact with the innermost layer of the multicomposition charge, than in the equivalent-mass configuration known in the prior art. As a result, the element according to the present invention can be initiated by a relay of smaller size, which on the one hand further reduces the vulnerability of the set comprising the casing load and relay, and on the other hand allow the use of composite explosives that are very difficult to prime, which were prohibited until now because of the size of the priming relays necessary and the attendant risks.

Hence the configuration according to the present invention makes it possible simultaneously to reduce the vulnerability of the charge with respect to detonation waves, which are generally lateral, caused by the close detonation by nearby munitions, and to increase its frontal primability in terms of a priming relay located on the axis of the charge in contact with the innermost layer. Such a result, that is, reducing the vulnerability of a charge while increasing its primability, is surprising to one skilled in the art and makes it possible to obtain quasi-invulnerable and/or low-vulnerability casing/-charge/relay munitions elements, which could not have been foreseen as feasible until now, considering the low primability of the charge.

The present invention accordingly has as its subject an explosive munitions element comprising a preferably metal casing containing a multicomposition explosive charge that includes a plurality of adjacent coaxial layers. The casing and each layer of the charge may have any form generated by revolution, for example cylindrical, ovoid, ellipsoid, spherical, conical, or hourglass-shaped. All of these shapes are purely approximate. The surfaces generated by revolution may in particular have irregularities, for example indentations or other voids. The layers need not be strictly coaxial. Moreover, the innermost layer is preferably solid, but it may also have one or more voids, for example a void for accommodating the priming system. The invention is characterized in that the innermost layer is a composite explosive comprising a filled polyurethane or polyester, preferably polyurethane, polymer matrix the powdered filling of which contains an organic nitrate explosive, the contents of which is greater than 20% by weight with respect to the composite explosive, preferably between 40% and 90%, and that the peripheral layer is a pyrotechnic composition of the family of composite solid propellants comprising a filled polyurethane or polyester, preferably polyurethane, polymer matrix the powdered filling of which contains at least one mineral oxidant and less than 17% by weight and preferably less than 10% by weight, of organic nitrate explosive, the percentage being expressed with respect to the pyrotechnic composition of the family of composite solid propellants. The term "less than 17% or 10%" is normally understood to mean that the content is either between 0 and 17% or 10% or 0; that is, in this second case, which is moreover preferred, the filling is free of organic nitrate explosive.

Preferably, the explosive charge is a bicomposition charge, with the inner layer sheathed with an adjacent peripheral coaxial layer. In the other cases, that is, when the charge includes more than two layers, the intermediate layer or layers are preferably of composite explosive, but certain layers, in particular those close to the peripheral layer, may be a pyrotechnic composition of the family of composite solid propellants.

Preferably, the polymer matrix of the composite explosive comprising the innermost layer and the polymer matrix of the pyrotechnic composition comprising the peripheral layer of the charge are identical, preferably being a polyurethane matrix. In this variant, when the charge contains more than two layers, the intermediate layers of composite explosive and/or pyrotechnic composition Of the family of composite solid propellants likewise have the same polymer matrix as the innermost layer and the peripheral layer. The polymer matrices may optionally include a plasticizer, such as those typically used when employing composite explosives and composite solid propellants.

Generally, in the context of the present invention the polyurethane polymer matrix is obtained by reaction of a prepolymer having hydroxyl terminal groups with a polyisocyanate.

Examples of prepolymers with hydroxyl terminal groups that can be cited are those in which the skeleton is a polyisobutylene, a polybutadiene, a polyether, a polyester, a polysiloxane. Preferably, a polybutadiene having hydroxyl terminal groups is used.

Examples of polyisocyanates that can be cited are isophorone diisocyanate (IPDI), toluene diisocyanate (TDI), dicyclohexylmethylene diisocyanate (Hylene W), hexamethylene diisocyanate (HMDI), biuret trihexane isocyanate (BTHI), and mixtures thereof.

When the polymer matrix is a polyester matrix, it is generally obtained by reaction with a prepolymer having carboxyl terminal groups, preferably a polybutadiene with carboxyl terminal groups (PBCT), or a polyester having carboxyl terminal groups, with a polyepoxide, for example a condensate of epichlorhydrin and glycerol, or a polyaziridine, for example trimethylaziridinyl phosphine oxide (MAPO).

In a variant of the invention, the filling of pyrotechnic composition of the family of composite solid propellants comprising the peripheral layer contains a mineral oxidant selected from the group comprising ammonium perchlorate, potassium perchlorate, ammonium nitrate, sodium nitrate, and mixtures thereof, that is, all mixtures of at least two of these products.

In another variant, the filling of pyrotechnic composition of the family of composite solid propellants comprising the peripheral layer contains a reducing metal, preferably selected from the group comprising aluminum, zirconium, magnesium, boron and mixtures thereof, that is, all mixtures of at least two of the four aforementioned metals. Particularly preferably, the reducing metal is aluminum.

As has already been mentioned, in a preferred variant, the filling of the pyrotechnic composition of the family of composite solid propellants comprising the peripheral layer is free of organic nitrate explosive. In this preferred variant, two particularly important subvariants should be mentioned.

In the first, the filling of the pyrotechnic composition comprising the peripheral layer is a mineral filling, preferably selected from the group comprising ammonium perchlorate, potassium perchlorate, ammonium nitrate, sodium nitrate, and their mixtures. The filling contains no other compound at all.

In the second subvariant, the filling of the pyrotechnic composition comprising the peripheral layer comprises solely a mixture of a reducing metal, preferably selected from the group comprising aluminum, zirconium, magnesium, boron and their mixtures, and a mineral oxidant preferably selected from the group comprising ammonium perchlorate, potassium perchlorate, ammonium nitrate, sodium nitrate and their mixtures. Preferably, the filling is a mixture of ammonium perchlorate and aluminum. In this case, the peripheral layer preferably comprises:

from 10% to 40% by weight of a polyurethane polymer matrix from 5% to 40% by weight of aluminum from 20% to 85% by weight of ammonium perchlorate, the sum of percentages being equal to 100.

In another variant of the invention, the organic nitrate explosive contained in the filling of the composite explosive comprising the innermost layer of the charge is selected from the group comprising Hexogen, Octogen, pentrite, 5-oxo-3-nitro-1,2,4-triazole, triaminotrinitrobenzene, nitroguanadine and their mixtures—that is, any mixtures of at least two of the aforementioned compounds. Preferably, this filling of organic nitrate explosive is selected from the group comprising Hexogen, Octogen, 5-oxo-3-nitro-1,2,4-triazole, and their mixtures.

In a preferred variant, the filling of composite explosive comprising the innermost layer of the charge comprises solely the organic nitrate explosive.

In the other cases—that is, when the filling of the composite explosive contains other ingredients—this filling preferably comprises solely the organic nitrate explosive in mixture with a filling selected from the group comprising ammonium perchlorate, potassium perchlorate, ammonium nitrate, sodium nitrate, reducing metals and their mixtures, that is, any mixtures of at least two of the aforementioned compounds. Particularly preferably, the filling of the composite explosive comprises solely the organic nitrate explosive in mixture with a filling selected from the group comprising ammonium perchlorate, aluminum, and their mixtures.

The innermost layer of composite explosive preferably comprises:

from 10% to 25% by weight of a polyurethane polymer matrix from 40% to 90% by weight of an organic nitrate explosive selected from the group comprising Hexogen, Octogen, 5-oxo-3-nitro-1,2,4-triazole and their mixtures.

from 0% to 35% by weight of aluminum from 0% to 45% by weight of ammonium perchlorate, the sum of percentages being equal to 100.

When the percentage of aluminum is other than 0, it is preferably between 5% and 35% by weight.

When the percentage of ammonium perchlorate is other than 0, it is preferably between 10% and 40% by weight.

When the percentage of aluminum and ammonium perchlorate is 0, the percentage of organic nitrate explosive is between 75% and 90% by weight.

The subject of the present invention is also a method for obtaining a blast and/or bubble effect by the release of gas in a very brief time, in the preferably metal casing of an explosive munitions casing comprising said casing containing an explosive charge, then rupture of the casing by the pressure of the gas formed. According to the invention, this method is characterized in that:

the explosive munitions element is an aforementioned element according to the present invention, that is, an element the explosive charge of which includes a plurality of adjacent coaxial layers, preferably two layers, the innermost, preferably solid, layer being a composite explosive comprising a filled polyurethane or polyester polymer matrix, the filling of which contains more than 20% by weight of organic nitrate explosive, the percentage being expressed with respect to the composite explosive, and the peripheral layer being a pyrotechnic composition of the family of composite solid propellants comprising a filled polyurethane or polyester matrix the filling of which contains at least one mineral oxidant and less than 17% by weight of organic nitrate explosive, the percentage being expressed with respect to the pyrotechnic composition. Preferably, this percentage is 0; that is, the filling is free of any organic nitrate explosive.

The release of gas is obtained by detonation of the composite explosive comprising the innermost layer of the charge, and then reaction without detonation of the pyrotechnic composition of the family of composite solid propellants comprising the peripheral layer, this reaction being initiated by the detonation wave resulting from the detonation of the composite explosive.

The following non-limiting examples illustrate the invention and the advantages it affords.

EXAMPLE 1

Lowering of the vulnerability of an explosive munitions element, the explosive charge of which is a polyurethane composite explosive filled with Hexogen, ammonium perchlorate and aluminum.

The composition of the composite explosive charge the vulnerability of which is to be lowered is as follows:

polyurethane polymer matrix obtained by reaction of a polybutadiene having hydroxyl terminal groups with IPDI: 12%

| | |
|---|---|
| Hexogen: | 20% |
| ammonium perchlorate: | 43% |
| aluminum: | 25% |

Such a charge is used in particular in mines and underwater torpedoes.

The cylindrical metal casing containing the charge is of steel, 12.5 mm in thickness. The diameter of the charge (inside diameter of the metal casing) is 248 mm, and its length is 450 mm.

A stack of two thus-constituted munitions elements, separated by 25 mm, was made along an earthwork, and then the priming of the lower element was achieved with the aid of a relay, 63 mm in diameter and 120 mm in length, of composite explosive the composition of which is 40% Octogen, 44% pentrite and 16% polyurethane binder, and a Davey Bickford SA 4000 detonator.

Detonation of the upper element by influence, even though it lacks a priming relay, is demonstrated.

According to the invention, in an identical metal casing, the fillings are distributed in the polyurethane polymer matrix of the charge in such a way as to make a bicomposition charge that is equivalent in mass to the foregoing one and has the same dimensions. The composition of each layer and the relative proportion in mass of the two layers in order to obtain equivalents can be found by simple calculations that are obvious to one skilled in the art. Numerous solutions result from these calculations. The bicomposition charge made comprises a solid cylinder of composite explosive the axis of which is that of the charge, which is 128 mm in diameter and the composition of which is 88% by weight of Hexogen and 12% by weight of the aforementioned polymer matrix, sheathed with a cylindrical ring of a pyrotechnic composition of the family of composite solid propellants having an inner diameter of 128 mm, an outer diameter of 248 mm, and hence a thickness of 60 mm, having a composition of 55.6% by weight of ammonium perchlorate, 32.4% by weight of aluminum and 12% by weight of the aforementioned polymer matrix. Except for the additives, this composition matches that of a propellant known as BUTALANE (trademark registered by SNPE). This bicomposition charge is made by the technique, well known to one skilled in the art of making composite explosives and multicomposition composite solid propellants, of sequential casting in molds, followed by polymerization.

The solid cylinder of composite explosive is provided with a priming system comprising a flat wave generator having a large diameter of 50 mm, and a length of 70 mm, located coaxially with respect to the charge, of bicomposition composite explosive (14% polyurethane binder and 86% Octogen for the first, and 11.5% polyurethane binder, 17% pentrite and 71.5% minimum for the second).

A stack of three munitions elements constituted in this way was made along an earthwork, that is, including the casing, the bicomposition charge, and the priming relay. The distance separating the elements was 25 mm.

Next, priming of the relay, and consequently priming of the composite explosive comprising the solid cylinder of the charge of the lower element, was done with the aid of a conventional detonator in contact with the relay.

Detonation of the composite explosive comprising the solid cylinder of the Charge of the lower element brought about the reaction, without detonation, of the propellant-type composition BUTALANE comprising the adjacent annular ring-shaped peripheral layer.

The nondetonation of the two upper receptor elements by influence was confirmed, despite the presence in these two elements of a priming system identical to that of the donor element, which demonstrates both the quasi-invulnerability of this munitions element with respect to the detonation wave, in particular in storage, and the importance of the invention, since the monocomposition charge of equivalent mass is vulnerable even when it lacks any priming system. This considerable lowering of vulnerability is not obtained to the detriment of the effects sought, since the aforementioned bicomposition element according to the invention has blast and/or bubble effects close to those obtained with the monocomposition element of equivalent mass.

In fact, the air shock pressures generated by detonation were measured by piezoresistive pickups mounted on lens-shaped supports located at distances varying between 10 m and 50 m from the detonation. These measurements make it possible to deduce a TNT equivalent of 1.7±0.2 for the munitions element with a monocomposition charge the vulnerability of which is to be lowered, and 1.6±0.2 for the munitions element according to the invention with a bicomposition charge of equivalent mass. The variation is not significant, considering the precision of the method. These results demonstrate that practically the same blast effect level is maintained.

In the context of this example, the increase in primability of the charge is difficult to measure, because the monocomposition charge of composite explosive the vulnerability of which to be lowered is already very easily primable.

EXAMPLE 2

Lowering of the vulnerability and increase in the primability of an explosive munitions element the explosive charge of which is a polyurethane composite explosive filled with ONTA, Octogen, ammonium perchlorate and aluminum.

The composition of composite explosive charge the vulnerability of which is to be lowered and the primability of which is to be increased is as follows:

polyurethane polymer matrix obtained by reaction of a polybutadiene having hydroxyl terminal groups with IPDI: 15%

| | |
|---|---|
| Octogen: | 6% |
| ONTA: | 31% |
| ammonium perchlorate: | 38% |
| aluminum: | 10% |

The cylindrical metal casing containing the charge is identical to that in Example 1.

This charge has a very high critical diameter, greater than 10 cm. Hence it is very difficult to prime. Only very large-sized relays can achieve this. Nevertheless, the vulnerability of such relays in practice prohibits the use of such a charge, particularly in mines, underwater torpedoes and general-use bombs.

According to the invention, in an identical metal casing, the fillings have been distributed in the polyurethane polymer matrix of the charge in such a way as to make a bicomposition charge of equivalent mass to the foregoing one and having the same dimensions. This bicomposition charge comprises a solid cylinder of composite explosive the axis of which is that of the charge, and which is 168 mm in diameter and the composition of which is 12% by weight of Octogen, 72% by weight of ONTA and 16% by weight of the aforementioned polymer matrix, sheathed with a cylindrical ring of a pyrotechnic composition of the family of composite solid propellants, having an inner diameter of 168 him, an outer diameter of 248 mm, and hence a thickness of 40 man, having a composition of 68% by weight of ammonium perchlorate, 18% by weight of aluminum and 14% by weight of the aforementioned polymer matrix. Except for the additives, this composition matches that of a BUTALANE propellant. This bicomposition charge was made by the same technique as that of Example 1.

The solid cylinder of composite explosive is provided with a priming system comprising a flat wave generator having a large diameter of 90 mm and a length of 80 mm, located coaxially with respect to the filling, of the same type as the generator used for Example 1.

A stack of three munitions elements constituted in this way was made along an earthwork, that is, including the casing, the bicomposition charge, and the priming relay. The distance separating the elements was 25 mm.

Next, priming of the relay was done, and consequently priming of the composite explosive comprising the solid cylinder of the charge of the lower element, with the aid of a conventional detonator in contact with the relay.

Detonation of the composite explosive comprising the solid cylinder of the charge of the lower element brought about the reaction, without detonation, of the propellant-type composition BUTALANE comprising the adjacent annular peripheral layer.

The nondetonation of the two upper receptor elements by influence was confirmed, despite the presence in these two elements of a priming system identical to that of the donor element.

This test demonstrates both the quasi-invulnerability of this "casing-charge-relay" munitions element with respect to the detonation wave, particularly in storage, and the importance of the invention, since the monocomposition charge of equivalent mass, which is overly difficult to prime, can in practice not be used, for the aforementioned reasons.

This result is not obtained to the detriment of the effects sought, since the aforementioned bicomposition element according to the invention has blast and/or bubble effects close to those obtained with the monocomposition element of equivalent mass.

We claim:

1. An explosive munitions element comprising a casing containing a multicomposition explosive charge including a plurality of adjacent coaxial layers, wherein the innermost layer is a composite explosive comprising a filled polyurethane or polyester polymer matrix, the filling of which contains more than 20% by weight of organic nitrate explosive, the percentage being expressed with respect to said composite explosive, and a peripheral layer comprising a pyrotechnic composition comprising a filled polyurethane or polyester polymer matrix, the filling of which contains at least one mineral oxidant and from 0 to less than 17 percent by weight of an organic nitrate explosive, the percentage being expressed with respect to said pyrotechnic composition.

2. The explosive munitions element of claim 1, wherein the polymer matrix of said innermost layer and said polymer matrix of said peripheral layer of said multicomposition explosive charge are identical.

3. The explosive munitions element of claim 1, wherein said polymer matrix of said innermost layer and said polymer matrix of said peripheral layer of said multicomposition explosive charge are polyurethane matrices.

4. The explosive munitions element of claim 1, wherein said polyurethane polymer matrix is obtained by reaction of a polybutadiene having hydroxyl terminal groups with a polyisocyanate.

5. The explosive munitions element of claim 1, wherein said explosive charge is a bicomposition charge, the inner layer being covered with a peripheral adjacent coaxial layer.

6. The explosive munitions element of claim 1, wherein the filling of said peripheral layer contains a mineral oxidant selected from the group consisting of ammonium perchlorate, potassium perchlorate, ammonium nitrate, sodium nitrate and mixtures thereof.

7. The explosive munitions element of claim 1, wherein the filling of said peripheral layer contains a reducing metal.

8. The explosive munitions element of claim 7, wherein the reducing metal is selected from the group consisting of aluminum, zirconium, magnesium, boron, and mixtures thereof.

9. The explosive munitions element of claim 1, wherein the filling of said peripheral layer is free of organic nitrate explosive.

10. The explosive munitions element of claim 1, wherein the filling of said peripheral layer is a mineral oxidant selected from the group consisting of ammonium perchlorate, potassium perchlorate, ammonium nitrate, sodium nitrate and mixtures thereof.

11. The explosive munitions element of claim 1, wherein the filling of said peripheral layer is a mixture of a reducing metal selected from the group consisting of aluminum, zirconium, magnesium, boron, and mixtures thereof, and a mineral oxidant selected from the group consisting of ammonium perchlorate, potassium perchlorate, ammonium nitrate, sodium nitrate, and mixtures thereof.

12. The explosive munitions element of claim 1, wherein the filling of said peripheral layer is a mixture of ammonium perchlorate and aluminum.

13. The explosive munitions element of claim 1, Wherein said organic nitrate explosive contained in the filling of said innermost layer of said multicomposition explosive charge is selected from the group consisting of Hexogen, Octogen, pentrite, 5-oxo-3-nitro-1,2,4-triazole, triaminotrinitrobenzene, nitroguanadine, and mixtures thereof.

14. The explosive munitions element of claim 1, wherein said organic nitrate explosive contained in the filling of said innermost layer of said multicomposition charge is selected from the group consisting of Hexogen, Octogen, 5-oxo-3-nitro-1,2,4-triazole, and mixtures thereof.

15. The explosive munitions element of claim 1 wherein the filling of said innermost layer of said multicomposition explosive charge is solely an organic nitrate explosive.

16. The explosive munitions element of claim 1, wherein the filling of said innermost layer of said multicomposition explosive charge is a mixture of (i) said organic nitrate explosive and (ii) a member selected from the group consisting of ammonium perchlorate, potassium perchlorate, ammonium nitrate, sodium nitrate, a reducing metal, and mixtures thereof.

17. The explosive munitions element of claim 1, wherein the filling of said innermost layer of said multicomposition explosive charge is a mixture of (i) said organic nitrate explosive and (ii) a member selected from the group consisting of ammonium perchlorate, aluminum, and mixtures thereof.

18. A method for obtaining a blast and/or bubble effect comprises releasing gas in the casing of an explosive munitions element of claim 1 by detonating the innermost composite explosive layer of said explosive munitions element without detonating the peripheral pyrotechnic composition layer of said explosive munitions element whereby the pressure of the released gas ruptures said casing thereby producing said blast and/or bubble effect and whereby the oxidation reaction of said peripheral pyrotechnic composition is initiated by the detonation wave resulting from the detonation of said innermost composite explosive layer.

19. The explosive munitions element of claim 2 wherein the filing of said peripheral layer contains from 0 to less than 10% by weight of said organic nitrate explosive.

* * * * *